US010193285B1

(12) United States Patent
Satyanarayanan et al.

(10) Patent No.: US 10,193,285 B1
(45) Date of Patent: Jan. 29, 2019

(54) ELECTRICAL OUTLET HAVING MOVABLE POWER MODULE

(71) Applicant: EATON CORPORATION, Cleveland, OH (US)

(72) Inventors: Karthik Satyanarayanan, Tamilnadu (IN); Pramod Kumar, Peachtree City, GA (US); Nilesh Ankush Kadam, Pune (IN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/692,178

(22) Filed: Aug. 31, 2017

(51) Int. Cl.

| | |
|---|---|
| ***H01R 27/02*** | (2006.01) |
| ***H01H 9/02*** | (2006.01) |
| ***H01R 24/60*** | (2011.01) |
| ***H01R 24/30*** | (2011.01) |
| ***H01R 13/44*** | (2006.01) |

(52) U.S. Cl.
CPC ..... *H01R 27/02* (2013.01); *H01H 9/0271* (2013.01); *H01R 13/44* (2013.01); *H01R 24/30* (2013.01); *H01R 24/60* (2013.01)

(58) Field of Classification Search
CPC ..... H01R 27/02; H01R 13/44; H01R 24/30; H01R 24/60; H01R 13/645; H01H 9/0271
USPC ..... 439/142, 640
See application file for complete search history.

(56) References Cited

U.S. PATENT DOCUMENTS

| | | | | |
|---|---|---|---|---|
| 7,066,767 | B2 * | 6/2006 | Liao | H01R 27/02 439/13 |
| 7,494,349 | B1 * | 2/2009 | Huang | H01R 27/00 439/131 |
| 7,540,748 | B2 * | 6/2009 | Tracy | G06F 1/1616 439/131 |
| 7,679,901 | B2 * | 3/2010 | Lin | G06F 1/1616 312/223.1 |
| 7,771,239 | B1 * | 8/2010 | Hsiao | H01R 35/04 439/640 |
| 7,811,102 | B2 * | 10/2010 | Lai | G06F 1/1616 361/679.55 |
| 8,157,574 | B2 * | 4/2012 | Hsiao | H01R 13/4532 439/131 |
| 9,019,721 | B2 * | 4/2015 | Chen | H05K 7/1427 361/810 |
| 9,509,104 | B2 * | 11/2016 | Wong | H01R 27/02 |
| 2017/0063008 | A1 * | 3/2017 | Goyal | H01R 27/02 |
| 2017/0141505 | A1 * | 5/2017 | Forti | H01R 25/006 |

* cited by examiner

*Primary Examiner* — Tulsidas C Patel
*Assistant Examiner* — Travis Chambers
(74) *Attorney, Agent, or Firm* — Eckert Seamans

(57) ABSTRACT

An electrical outlet includes a base and further includes a power module that is movably situated on the base. The power module is movable among a plurality of different orientations on the electrical outlet. The power module includes different electronic devices on each of a plurality of surface portions of the power module. As the power module is moved with respect to the electrical outlet among the different orientations, a different exposed surface portion faces away from the electrical outlet, and a different electrical device that is situated on or adjacent the exposed surface portion is operable to output electrical power or to perform some other function. The various electrical devices can be selected to provide a balance of electrical services, such as multiple types of USB ports, wireless recharging, a nightlight, and the like, without limitation.

20 Claims, 9 Drawing Sheets

ELECTRICAL OUTLET HAVING MOVABLE POWER MODULE

BACKGROUND

Field

The disclosed and claimed concept relates generally to electrical devices and, more particularly, to an electrical outlet having a power module that is movably situated thereon.

Related Art

Numerous types of electrical outlets are known in the relevant art. Many known electrical outlets provide power at a domestic voltage level which may be, for instance, 120 volts AC or 240 volts AC, by way of example. It is also known that a number of electronic devices can be powered using a Universal Serial Bus (USB) power outlet which, outputs 5 volts DC. It is further known, however, that numerous types of USB connectors and outlets exist and can include, among other examples, USB type A outlets, USB type C outlets, and other such outlets. As such, the installation of an electrical outlet that includes a USB type A outlet will be unusable to charge a device that requires a USB type C outlet unless some type of a conversion cable or other adapter is employed. Furthermore, some electronic devices can be charged wirelessly, although different manufacturers employ different communication protocols and recharging parameters in order to wirelessly charge appropriate electronic devices. Improvements thus would be desirable.

SUMMARY

An improved electrical outlet includes a base and further includes a power module that is movably situated on the base. The power module is movable among a plurality of different orientations on the electrical outlet. The power module includes different electronic devices on each of a plurality of surface portions of the power module. As the power module is moved with respect to the electrical outlet among the different orientations, a different exposed surface portion faces away from the electrical outlet, and a different electrical device that is situated on or adjacent the exposed surface portion is operable to output electrical power or to perform some other function. The various electrical devices can be selected to provide a balance of electrical services, such as multiple types of USB ports, wireless recharging, a nightlight, and the like, without limitation.

Accordingly, an aspect of the disclosed and claimed concept is to provide an improved electrical outlet having a power module movably situated thereon, with the power module being providing a number of electrical devices that provide different selectable electrical features on the electrical outlet.

As employed herein, the expression "a number of" and variations thereof shall refer broadly to any non-zero quantity, including a quantity of one.

Accordingly, an aspect of the disclosed and claimed concept is to provide an improved electrical outlet structured to be electrically connected with a line conductor and a neutral conductor of an AC power source. The electrical outlet can be generally stated as including a base, an electrical apparatus situated on the base, the electrical apparatus can be generally stated as including a power module situated on the base, the power module having a plurality of electrical devices disposed thereon, at least a first electrical device of the plurality of electrical devices being an electrical output device that is structured to output electrical power, the power module having an exterior surface, the exterior surface comprising a plurality of surface portions, each surface portion of at least some of the plurality of surface portions having at least a portion of at least a first electrical device of the plurality of electrical devices being situated adjacent thereto, the power module being movable among a plurality of positions with respect to the base, in each position of at least a plural quantity of the plurality of positions, a surface portion of the plurality of surface portions facing away from the base and the at least first electrical device situated adjacent the surface portion being electrically operable.

BRIEF DESCRIPTION OF THE DRAWINGS

A further understanding of the disclosed and claimed concept can be gained from the following Description when read in conjunction with the accompanying drawings in, which:

Similar numerals refer to similar parts throughout the specification.

DESCRIPTION

Figure 3:
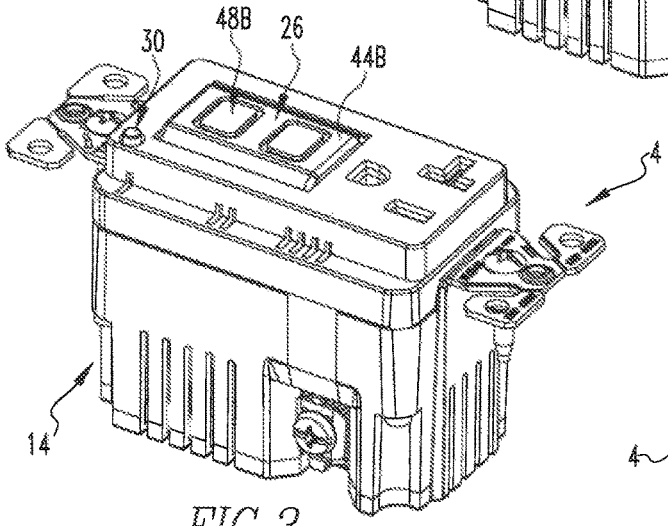
FIG. 3 is a view similar to FIGS. 1 and 2, except depicting the power module in the second orientation.
Figure 4:
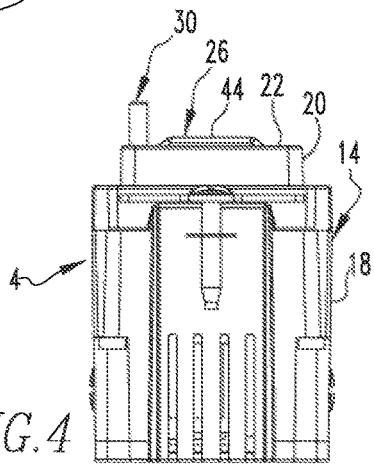
FIG. 4 is an end view of the electrical outlet of FIG. 1.
Figure 5:
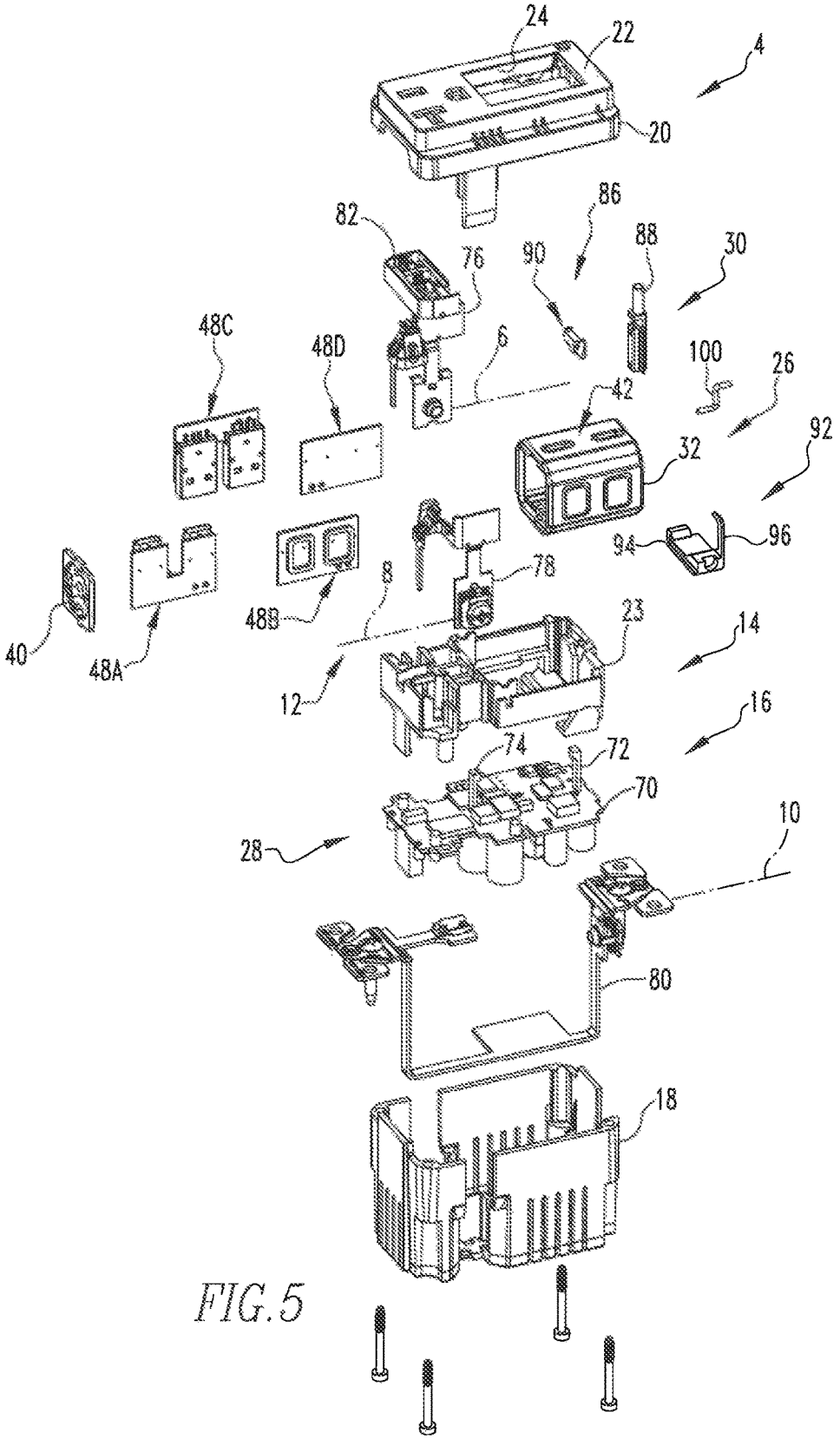
FIG. 5 is an exploded view of the electrical outlet of FIG. 1.

An improved electrical outlet 4 in accordance with a first embodiment of the disclosed and claimed concept is depicted in an assembled fashion, in FIGS. 1-4 and is depicted in an exploded fashion in FIG. 5. As can be understood from FIG. 5, the electrical outlet 4 is structured to be electrically connected with an AC power source 12 and, more particularly, with a line conductor 6, a neutral conductor 8, and a ground conductor 10 of the AC power source 12. The electrical outlet 4 is configured to be mounted to a wall, for instance, through the use of an electrical box or otherwise, and to be connected with the AC power source 12 via conductors that are situated within the wall. It is understood that the teachings herein not be limited to a wall electrical outlet and rather can be applied in any type of an electrical environment.

The electrical outlet 4 can be said to include a base 14 and an electrical apparatus 16, with the electrical apparatus 16 being situated on the base 14. The base 14 is depicted in the accompanying figures as including a rear housing 18 and a front housing 20 that are connected together, with the front housing 20 being intended to face away from the wall upon which the electrical outlet 4 is mounted. The base 14 further includes an inner housing 23 that is depicted in FIG. 5, by way of example, and that is situated within an open region within the interior of the base 14. The front housing 20 has a frontal surface 22 that is of a generally planar configuration. The frontal surface 22 has a receptacle 24 formed therein.

Figure 6:
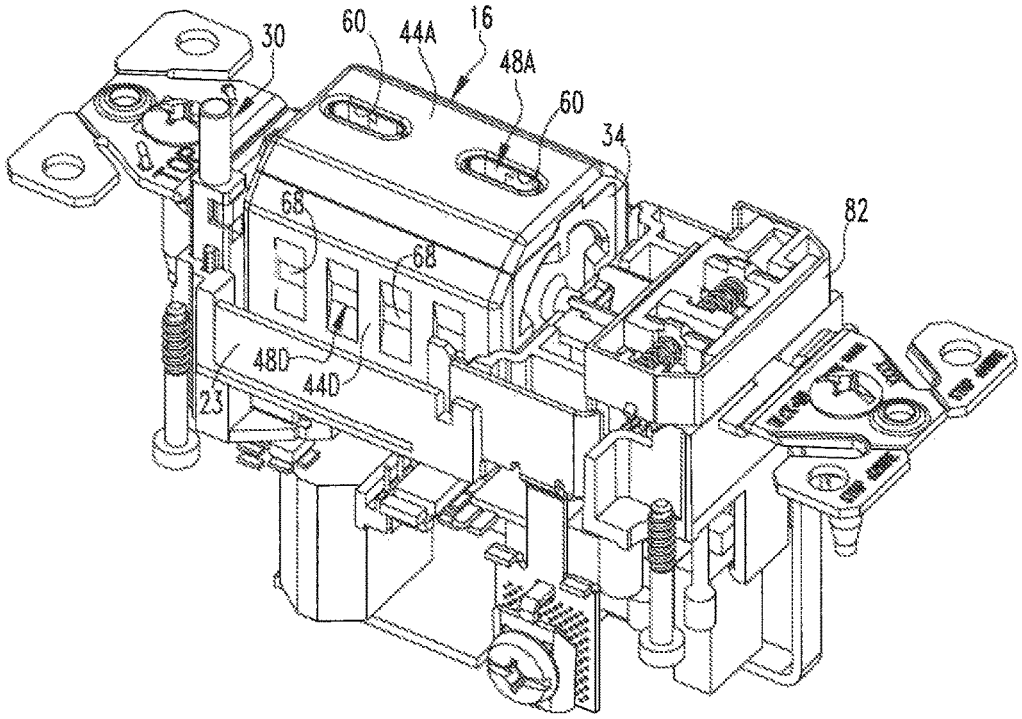
FIG. 6 is a perspective view of an electrical apparatus situated on an inner housing of the electrical outlet of FIG. 1.

The electrical apparatus 16 can be said to include a power module 26 that is situated in the receptacle 24 and that is movable with respect to the base 14 in a fashion that will be set forth in greater detail below. As can be understood from FIGS. 5 and 6, the electrical apparatus 16 further includes a power delivery system 28 and an actuation apparatus 30.

The power module 26 is more particularly depicted in FIGS. 7-11. For instance, the power module 26 includes an end 32 that is depicted generally in FIG. 7 and another end 34 that is depicted generally in FIG. 8. As can be understood from FIGS. 8, 10, and 11, the power module 26 has an opening 36 formed in the end 34 and includes a hollow cavity 38 formed therein. The power module 26 includes a cap 40 that is received in the opening 36 to form a portion of the end 34.

As can be understood from FIGS. 7-10, the power module 26 includes an exterior surface 42 that extends generally between the ends 32 and 34. The exterior surface 42 includes a plurality of surface portions 44A, 44B, 44C, and 44D, which may be collectively or individually referred to herein with the numeral 44, The power module 26 further includes as a part of the exterior surface 42 a plurality of radiused regions 46, with each radius region 46 being interposed between an adjacent pair of the surface portions 44. The radiused portions 46 can be radiused or chamfered or otherwise formed to have material removed therefrom to permit rotation of the power module 26 within the receptacle 24.

Figure 8:
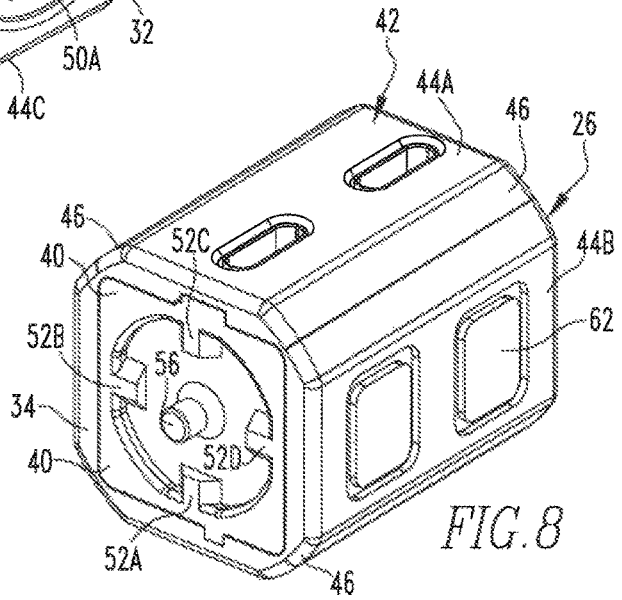
FIG. 8 is another perspective view of the power module.
Figure 9:
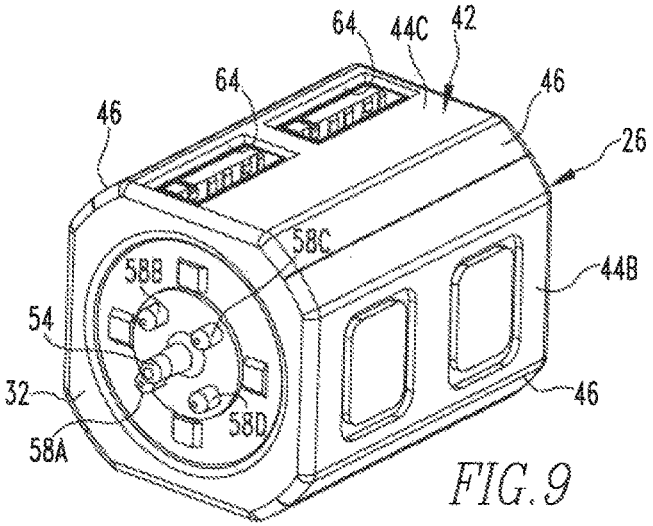
FIG. 9 is another perspective view of the power module.
Figure 10:
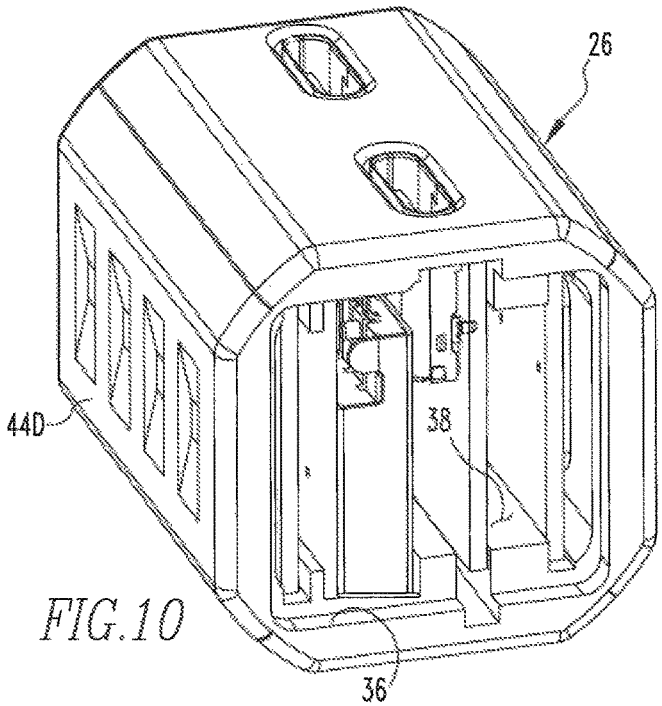
FIG. 10 is a perspective view of a portion of the power module.
Figure 11:
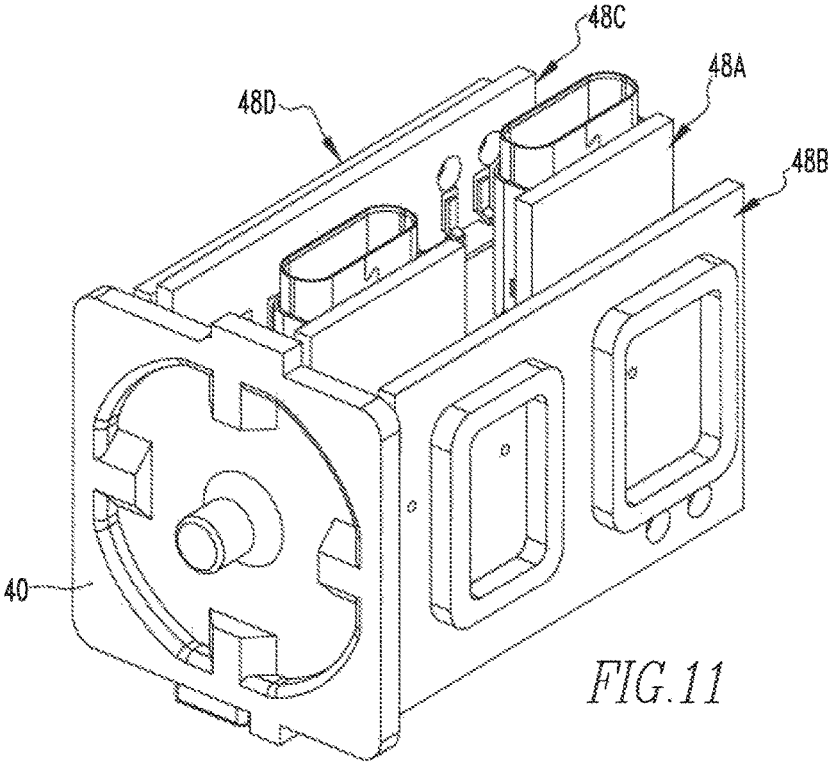
FIG. 11 is a perspective view of another portion of the power module.

As can be understood from FIGS. 7-11 and, more specifically, FIGS. 10 and 11, the power module 26 includes a plurality of electrical devices that are situated thereon and that are indicated at the numerals 48A, 48B, 48C, and 48D, and which may be collectively or individually referred to herein with the numeral 48. The electrical devices 48 are devices that are electrically powered by the power delivery system 28 and which perform some type of electrical operation, and at least some of which are configured to output electrical power, such as to another device. Each of the surface portions 44 has one of the electrical devices 48 situated adjacent thereto. More specifically, the surface portions 44A, 44B, 44C, and 44D have the electrical devices 48A, 48B, 48C, and 48D, respectively, situated adjacent thereto.

The electrical devices 48 of the depicted exemplary embodiment are powered by electrical contacts that are situated on the ends 32 and 34. More specifically, the end 32 has a plurality of first electrical contacts situated thereon and which are indicated at the numerals 50A, 50B, 50C, and 50D, and which may be collectively or individually referred to herein with the numeral 50. The end 32 likewise has a plurality of second electrical contacts situated thereon and which are indicated at the numerals 52A, 52B, 52C, and 52D, and which may be collectively or individually referred to herein with the numeral 52. The electrical device 48A is electrically connected with and is powered by the first and second electrical contacts 50A and 52A. Likewise, the electrical device 48B is electrically connected with and powered by the first and second electrical contacts 50B and 52B. Similarly, the electrical device 48C is electrically connected with and powered by the first and second electrical contacts 50C and 52C. Likewise, the electrical device 48D is electrically connected with and is powered by the first and second electrical contacts 50D and 52D.

Figure 7:
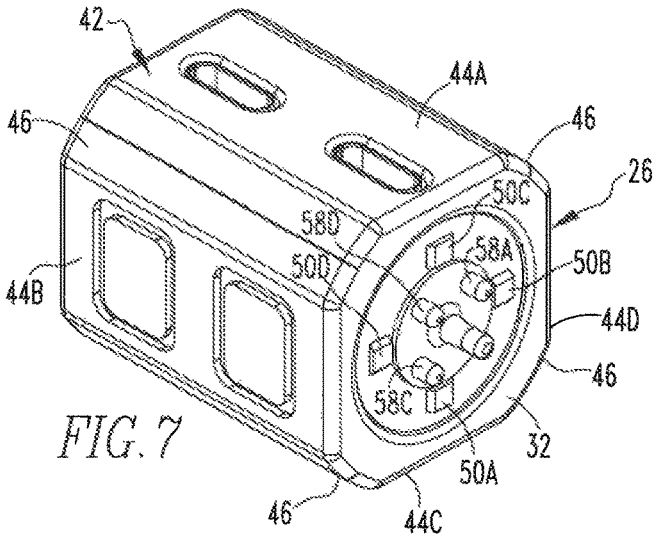
FIG. 7 is a perspective view of the power module of the electrical outlet of FIG. 1.
Figure 18:
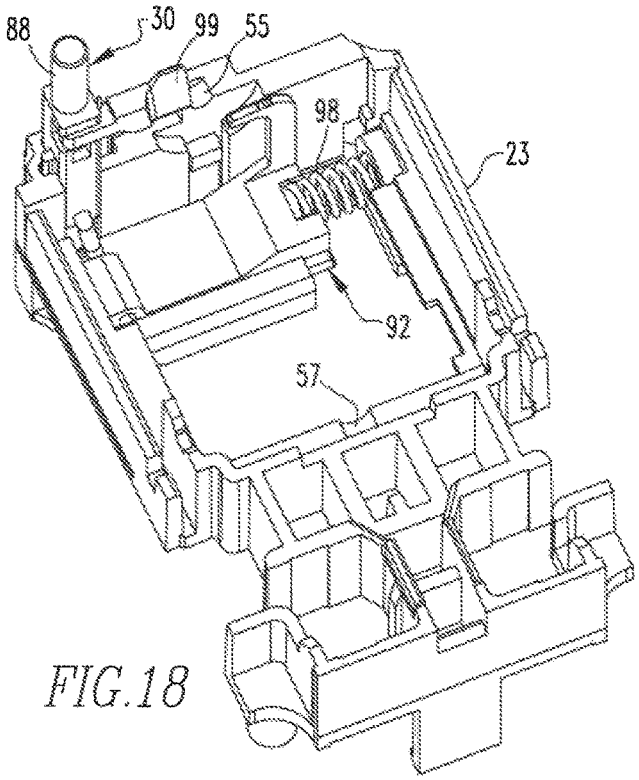
FIG. 18 depicts an actuation apparatus of the electrical apparatus of FIG. 6 being situated on a portion of an inner housing of the electrical apparatus, with the actuation apparatus being in the first position.
Figure 19:
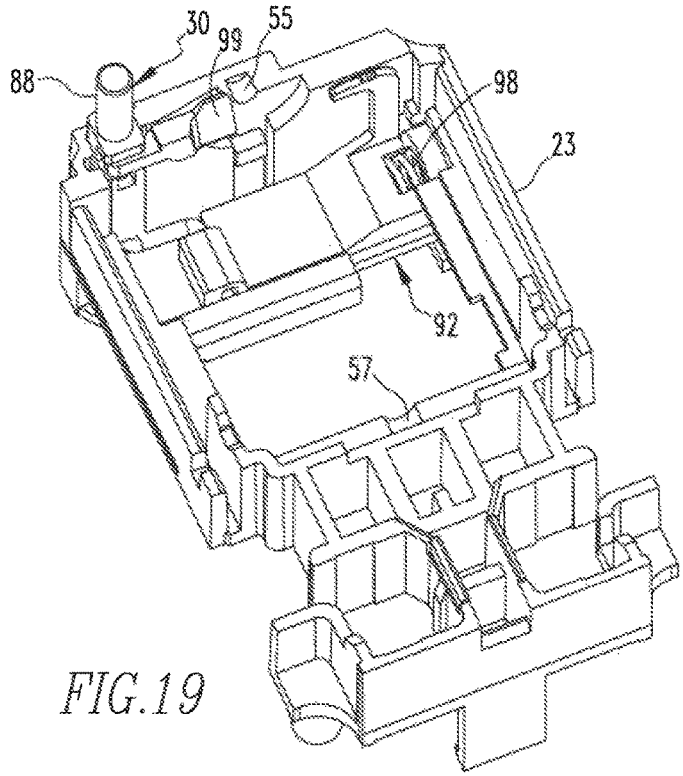
FIG. 19 is a view similar to FIG. 18, except depicting the actuation apparatus in the second position.

As can be seen in FIGS. 7-9, the end 32 has a hub 54 formed thereon that is of a cylindrical configuration. Likewise, the end 34 has a hub 56 formed thereon that is of a cylindrical configuration. The hubs 54 and 56 are rotatably situated on a pair of seats 55 and 57, respectively, that are formed on the inner housing 23 and that are depicted in FIGS. 18 and 19. The end 32 further has situated thereon a plurality of pegs that are indicated at the numerals 58A, 58B, 58C, and 58D, and which may be collectively or individually referred to herein with the numeral 58. As will be set forth in greater detail below, the pegs 58 are cooperable with the actuation apparatus 30 to rotate the power module 26 among, a plurality of orientations with respect to the base 14.

As can further be understood from FIGS. 7-11, the various electrical devices 48 are components that are mounted to the cap 40 and that are receivable in the cavity 38 to form the power module 26. Each of the exemplary electrical devices 48 in the depicted exemplary embodiment includes a number of components that are mounted to a corresponding printed circuit board. For instance, the electrical device 48A includes a pair of US B type C receptacles 60 that are situated adjacent the surface portion 44A and that are situated adjacent corresponding openings formed in the surface portion 44A. The electrical device 48A thus provides a pair of USB type C receptacles 60 that are mounted on a printed circuit board and that are capable of providing electrical power to a device that is connected with either such receptacle 60 when the power module 26 is oriented such that the surface portion 44A faces away from the base 14.

In a similar fashion, the electrical device 48B includes a printed circuit board upon which a number of windings 62 and an electrical antenna are situated. The electrical device 48B further includes some logic or executable instructions resident thereon which enable wireless communication with an appropriate separate electronic device in order to ensure that the windings 62 will be suitably cooperable with the electronic device. If an electronic device is brought into proximity with the windings 62, the antenna will execute the appropriate communications with the separate electronic device according to the communications protocol stored thereon and, if appropriate, the windings 62 will output electrical power to corresponding windings on the separate electronic device. In such a fashion, electrical power will be communicated from the electrical device 48B to an electronic device in a fashion similar to the way in which current is induced in the secondary windings of a transformer when the power module 26 is oriented such that the surface portion 44B faces away from the base 14. The windings 62 are situated adjacent the surface portion 44B.

The electrical device 48C includes a printed circuit board upon which a pair of USB type A receptacles 64 are situated. The USB type A receptacles 64 are situated adjacent the surface portion 44C and are accessed through corresponding holes formed in the surface portion 44C to power an electronic device that is connected with either such receptacle 64 when the power module 26 is oriented such that the surface portion 44C faces away from the base 14.

The electrical device 48D includes a plurality of LEDs 68 that are situated on a corresponding printed circuit board and which shine through openings formed in the surface portion 44D. The LEDs 68 are thus situated adjacent the surface portion 44D and function as an illumination device, such as a nightlight, etc., when the power module 26 is oriented such that the surface portion 44D faces away from the base 14.

As can be understood from the accompanying drawings, the exemplary power module 26 has the four surface portions 44 formed thereon, each of which has a corresponding electrical device 48 situated adjacent thereto for a total of four electrical devices, Of the exemplary four electrical devices 48, two are USB power outlets, one is a wireless power outlet, and the fourth is an electrically operated illumination apparatus. It is understood, however, that these are merely examples of how one exemplary power module 26 has been configured. It is understood that other variations are possible without departing from the spirit of the disclosed and claimed concept. For instance, other embodiments of the power module may include a greater or lesser number of surface portions, such as anywhere between three and eight or more surface portions depending upon the needs of the given application. Furthermore, any of a wide variety of electrical devices can be provided on such surface portions. For instance, other types of USB ports and other combinations of USB ports can be provided on various surfaces. Furthermore, other types of wireless charging electrical devices can be provided. It is currently known that Apple and Samsung offer for sale electronic devices that are wirelessly charged, and the charging protocols of such devices are different from one another. It is envisioned that other manufacturers will provide additional protocols and wireless charging methodologies that may likewise be still different. An alternative embodiment of the power, module 26 might therefore have four different wireless charging devices on four surface portions rather than having the surface portions and the electrical devices 48 that are expressly depicted herein. On a power module having eight faces and corresponding electrical devices, such a device could include four different wireless charging electrical devices and three or more USB electrical devices or other electrical devices, by way of example. Other variations will be apparent. It thus is expressed that the exemplary power module 26 that is depicted herein is provided merely as an example of one such type of power module and is not intended to be any fashion limiting.

Figure 12:
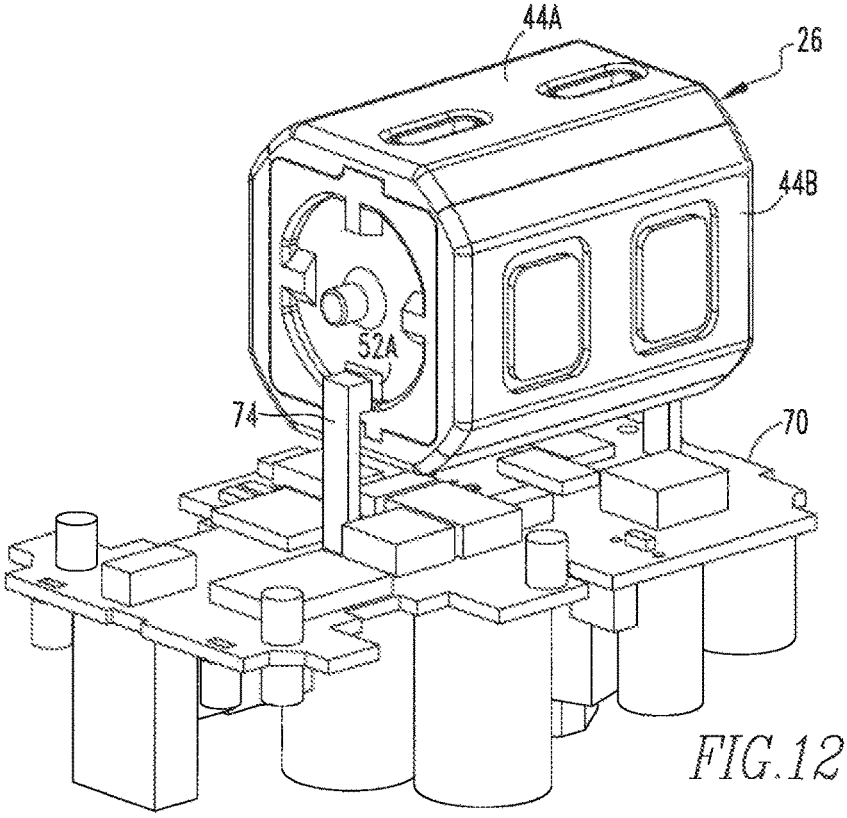
FIG. 12 is a perspective view of a portion of the electrical apparatus of FIG. 6.
Figure 13:
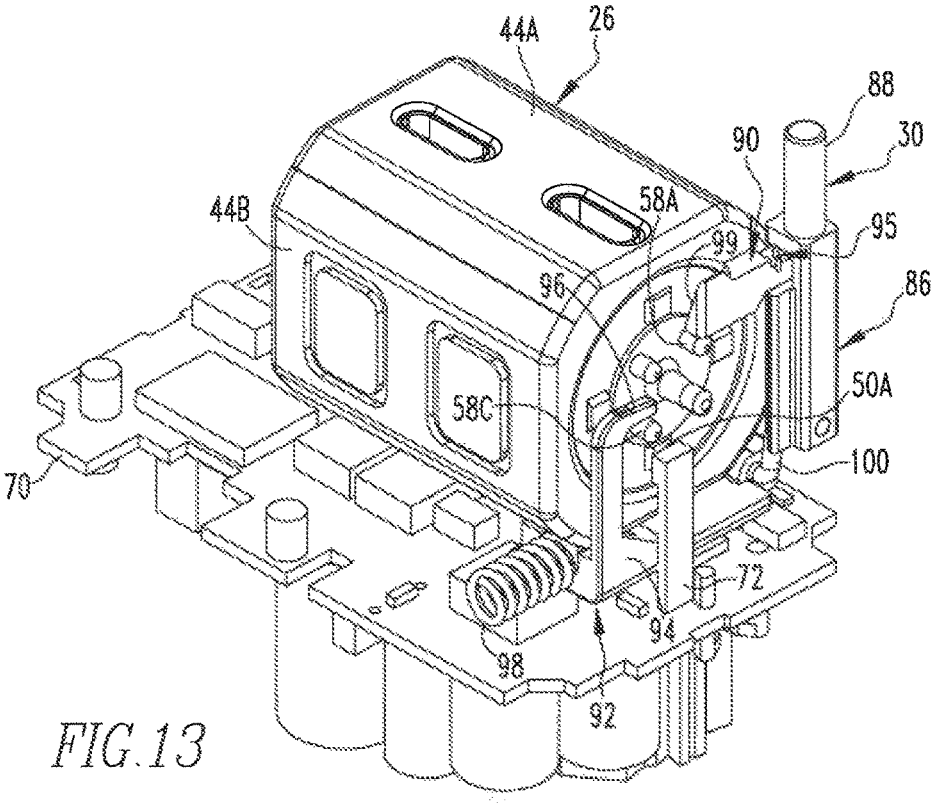
FIG. 13 is another perspective view of another portion of the electrical apparatus of FIG. 6, with the power module being in a first orientation and with an actuation apparatus being in a first position.

As can be understood from FIGS. 12 and 13, the power delivery system 28 includes a printed circuit board 70, an electrical connector 72 that is separately electrically connectable with the first electrical contacts 50, and another electrical connector 74 that is separately electrically connectable with the second electronic contacts 52. The electrical conductors 72 and 74 are electrically connected with and powered by the printed circuit board 70. The voltage that is provided to the electrical conductors 72 and 74 can be controlled by the printed circuit board 70 as needed, and if desired. In this regard, it is reiterated that USB power outlets output 5 volts DC power.

As can be seen in FIG. 5, the power delivery system 28 further includes a line bus 72, a neutral bus 78, and a ground bus 80. The power delivery system 28 further includes a PR shutter 82 (FIGS. 5 and 6) that is situated on the inner housing 23 atop portions of the line and neutral buses 76 and 78 and which is a child resistant device that operates in a known fashion. It can be understood that the line bus 76, the neutral bus 78, and the ground bus 80 together provide a power outlet 84 that is situated on the base 14 and which is accessible through openings in the frontal surface 22 of the front housing 20. The power outlet 84 thus provides electrical power in addition to the electrical power and features that are provided by the power module 26.

Figure 1:
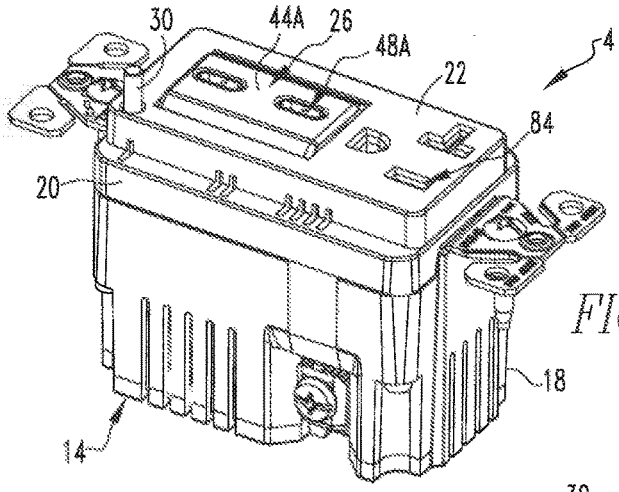
FIG. 1 is a perspective view of an improved electrical outlet in accordance with a first embodiment of the disclosed and claimed concept with a power module thereof being in a first orientation thereon.

FIG. 13 depicts the actuation apparatus 30 in a first position and further depicts the power module 26 in the first orientation, and it is noted that the first position of the actuation apparatus 30 and the first orientation of the power module 26 in FIG. 13 are the same as depicted in FIG. 1. As such, FIG. 13 depicts the first orientation of the power module 26 as being that in which the surface portion 44 faces generally away from the base 14 and the frontal surface 22, such as is likewise depicted in FIG. 1. FIG. 12 likewise depicts the first orientation of the power module 26. It can be understood from FIGS. 12 and 13 that in the first orientation of the power module 26 wherein the surface portion 44A faces generally away from the base 14 and wherein the electrical device 48A faces generally away from the base 14, the electrical connector 72 is electrically connected with the first electrical contact 50A, and the electrical connector 74 is electrically connected with the second electrical contact 52A. Inasmuch as the first and second electrical contacts 50A and 52A are electrically connected with the electrical device 48A, it can be understood that in the first orientation of the power module 26 such as is depicted in FIGS. 1, 12, and 13, the USB type C receptacles 60 are operably positioned by facing away from the base 14. Moreover, such USB type C receptacles 60 are electrically powered by the power delivery system 28 and its electrical connectors 72 and 74 being electrically connected with the first and second electrical contacts 50A and 52A. It can furthermore be seen in the depicted exemplary embodiment that the electrical connectors 72 and 74 are electrically disconnected from the electrical devices 48B, 48C, and 48D in the first orientation of the power module 26. In second, third, and fourth orientations of the power module 26 wherein the surface portions 44B, 44C, and 44D, respectively, are situated facing, away from the base 14 and the frontal surface, their respective first and second electrical contacts 50 and 52 are successively electrically connected with the electrical conductors 72 and 74 to power the corresponding electrical devices 48B, 48C, and 48D, respectively, to cause them to be operative, both in terms of positioning and in terms of being electrically, powered. It is noted, however, that in, other embodiments all of the electrical devices 48 may be simultaneously electrically connected with the printed circuit board 70 without departing from the spirit of the present disclosure.

As can be understood from FIGS. 13-17, the actuation apparatus 30 can be said to include an actuator 86, and the actuator 86 can be said to include a pushbutton 88 that is movably situated on the base 14 and a latch 90 that is movably situated on the pushbutton 88. The actuation apparatus 30 further includes a locking apparatus 92 that can be said to include a base 94, a lock 96 that is situated on the base 94, and a spring 98 that is interposed between the base 94 and an interior surface of the inner housing 23. The spring 98 biases the locking apparatus 92 in the rightward direction from the perspective of FIGS. 14-17. The actuation apparatus 30 further includes a link 100 that mechanically connects between the pushbutton 90 and the base 94 and which communicates a reciprocation of the pushbutton 88 into a corresponding reciprocation of the base 94.

Figure 14:
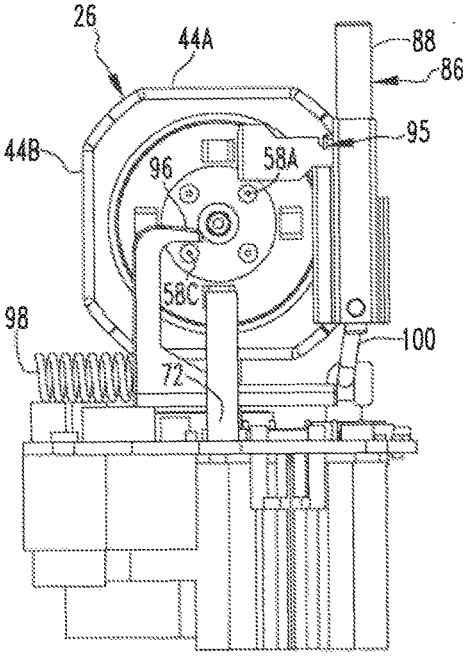
FIG. 14 is a view similar to FIG. 13, except depicting an end view of the portion of the electrical apparatus.

It can be seen that FIG. 14 is a view similar to FIG. 13, except depicting an end view of the power module 26. As can be understood from the foregoing, FIG. 14 thus depicts the actuation apparatus 30 in its first position and depicts the power module 26 in its first orientation. It can further be seen from FIG. 14 that the latch 90 is situated above the peg 58A and that the lock 96 is situated above the peg 58C, both from the perspective of FIG. 14. As can be understood from FIGS. 13 and 14, the positioning, of the latch 90 and the lock 96 in proximity to the pegs 58A and 58C, respectively, resists movement of the power module 26 with respect to the base 14 inasmuch as any attempted rotation of the power module 26 within the receptacle 24 would either cause the peg 58A to engage the underside of the latch 90 or would cause the peg 58C to engage the underside of the lock 96. It thus can be seen that in the first position of the actuation apparatus 30, the actuation apparatus 30 interacts with the pegs 58 to resist movement of the power module 26 away from whatever is the current orientation of the power module 26 on the base 14. This is advantageous because it avoids unintended access to the interior of the electrical outlet 4 by unauthorized persons.

Figure 2:
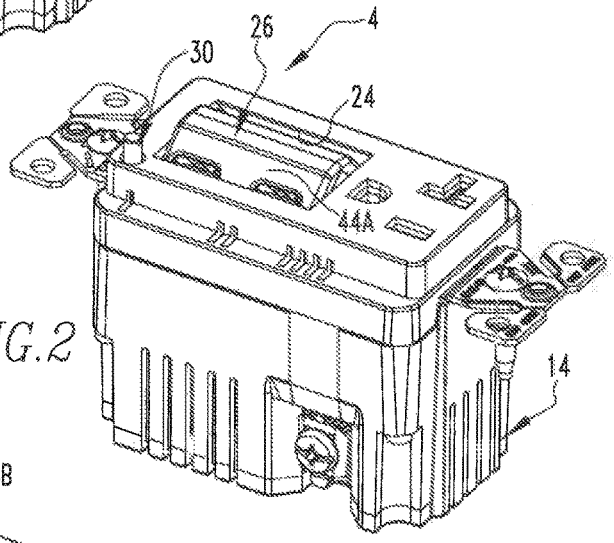
FIG. 2 is a view similar to FIG. 1, except depicting the power module in a transition state between the first orientation of FIG. 1 and a second orientation.
Figure 15:
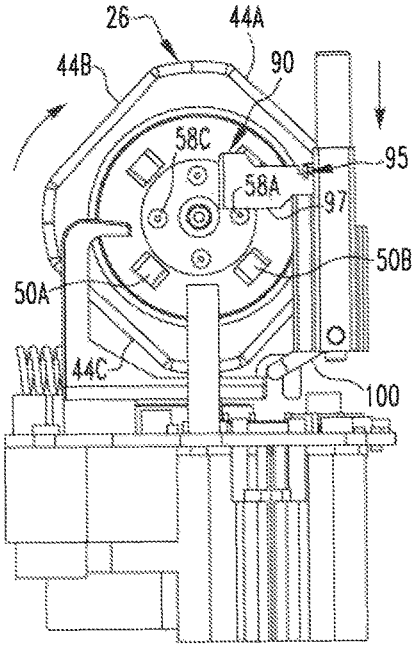
FIG. 15 is a view similar to FIG. 14, except depicting the power module in a transition state between the first orientation and the second position, and also depicting the actuation apparatus in a transition state between the first position and a second position.
Figure 16:
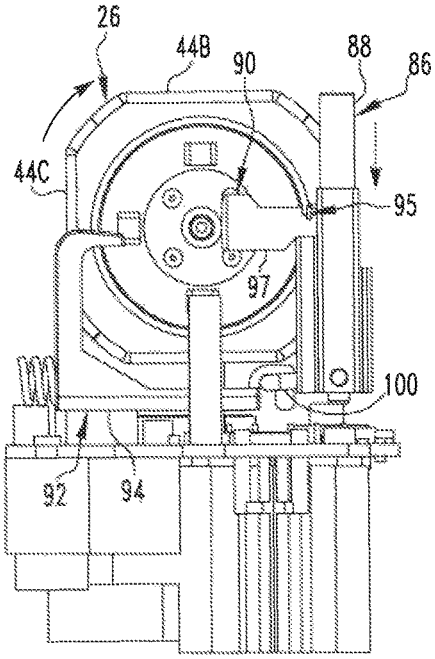
FIG. 16 is a view similar to FIGS. 14-15, except depicting the power module being in the second orientation and depicting the actuation apparatus in the second position.
Figure 17:
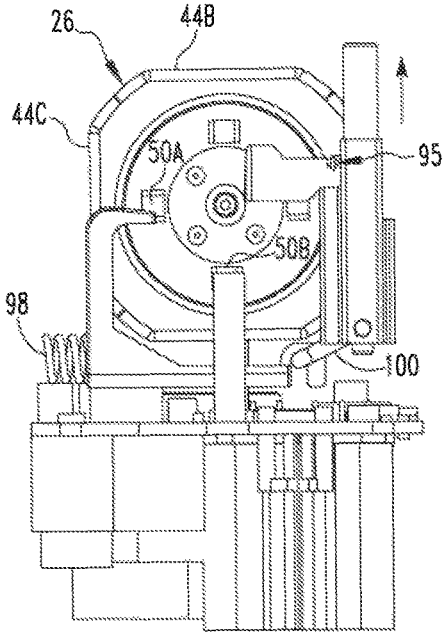
FIG. 17 is a view similar to FIG. 16, except depicting the actuation apparatus in another transition state midway between the First and second positions when returning from the second position to the first position.

In order to rotate the power module 26 from the first orientation that is depicted in FIGS. 1 and 12-14 into the second orientation that is depicted in FIGS. 3 and 16-17, the pushbutton 88 is manually depressed in a downward direction from the perspective of FIGS. 14-17. Such movement of the pushbutton 88 in the downward direction causes an engagement, surface 97 of the latch 90 to engage the peg 58A and to move the peg 58A in the downward direction, which results in rotation of the power module 26 in the clockwise direction from the perspective of FIG. 15. Substantially simultaneously therewith, the downward motion of the pushbutton 88 causes the link 100 to push the base 94 in the leftward direction from the perspective of FIG. 15 which causes the lock 96 to likewise move in the leftward direction and to clear the peg 58C. Such contemporaneous engagement by the latch 90 with the peg 58A and disengagement of the lock 96 from the peg 58C permits such rotational movement. That is, the lock 96 in the position of FIG. 14 would resist movement of the power module 26 by virtue of the engagement of the lock 96 with the peg 58C, but the downward movement of the pushbutton 88 causes, via the link 100, a disengagement of the lock 96 from the peg 58C, thereby permitting such rotational movement of the power module 26. It is noted that the position of the power module 26 and of the actuation apparatus 30 in FIG. 15 is the same as that which is depicted in FIG. 2.

Continued pressing of the pushbutton 88 in the downward direction results in the actuation apparatus 30 being moved to a second position, such as is depicted in FIG. 16, and with the power module 26 being rotated to the second orientation with respect to the base 14. It is noted that the second position of the actuation apparatus 30 and the second orientation of the power module 26, as are depicted in FIG. 16, are the same as those which are depicted in FIG. 3. As can be seen in FIG. 16, the pushbutton 88 translated from its uppermost position of FIG. 14 to its fully downward position in FIG. 16 has rotated the power module 26 through 90 degrees of rotation Such rotation has positioned the power module 26 in its second orientation wherein the surface portion 44B faces generally away from the base 14 and from the frontal surface 22, and wherein the electrical connectors 72 and 74 are electrically connected with the first and second electrical contacts 50B and 52B to thereby energize the electrical device 48B and to make it operative by causing the windings 62 to face generally away from the base 14 for use in recharging a separate electronic device.

It can further be seen from FIG. 16 that a ramped surface 99 (FIGS. 13, 18, and 19) of the latch 90 is engaged with the peg 58B. Furthermore in the fully downward position of the pushbutton 88, the locking apparatus 92 has been pushed to its left-most position overcoming the bias of the spring 98.

When the force that has been applied to the pushbutton 88 to depress it to the second position of FIG. 16 has been removed, the biasing spring 98 causes the locking, apparatus 92 to move in the rightward direction from the perspective of FIG. 17, which likewise causes the pushbutton 88 to move in the upward direction from the perspective of FIG. 17. FIG. 17 depicts the actuation apparatus 30 returned approximately halfway from the second position of FIG. 16 toward the first position of FIG. 14, In FIG. 17, it can be understood that the ramped surface 99 is riding on the end of the peg 58B, and in this regard it is understood that the latch 90 is movably situated on the pushbutton 88. A spring 95 extends between the latch 90 and the pushbutton 88, and the engagement of the peg 58B with the ramped surface 99 causes the latch 90 to rotate slightly out of the plane of the page of FIG. 17, thereby overcoming the bias of the spring 95. However, it can be understood that as the pushbutton 88 travels farther in the upward direction, and as the locking apparatus 92 moves farther in the rightward direction, both from the perspective of FIG. 17, and as a result of the bias of the spring 98, the spring 95 will cause the latch 90 to move back into the plane of the page of FIG. 17 after the engagement surface 97 clears the peg 58B, at which point it will come to rest atop the peg 58B in the second orientation of the power module 26. In such position, the actuation apparatus 30 will have returned to its first position and the power module 26 will be in its second orientation. Furthermore, the lock 96 will have returned to its position (such as is depicted in FIG. 14) but will be situated above the peg 58D. As such, it can be understood that when the power module 26 is in its second orientation and when the actuation apparatus 30 has returned to its first position, the latch 90 will be situated above the peg 58B, and the lock 96 will be situated above the peg 58D, thereby resisting movement of the power module 26 with respect to the base 14. That is, such motion of the power module 26 is thereby resisted unless the pushbutton 88 is actuated to cause the power module 26 to go through its third and fourth orientations wherein the surface portions 44C and 44D, respectively, will face away from the base 14, and wherein the electrical devices 48C and 48D will be operative by reason of their electrical connection, respectively, with the electrical connectors 72 and 74 and due to their facing generally away from the frontal surface 22 and the base 14. Continued actuations of the actuation apparatus 30 successively and repetitively move the power module 26 through first, second, third, and fourth orientations with respect to the base 14.

As can be understood from FIG. 4, the surface portion 44 that faces generally away from the base 14 in any orientation of the power module 26 protrudes slightly from the frontal surface 22. That is, in any of the four exemplary orientations of the power module 26, the operative electrical device 48 and the corresponding surface portion 44 are situated such that they protrude slightly outwardly from the frontal surface 22.

Figure 20:
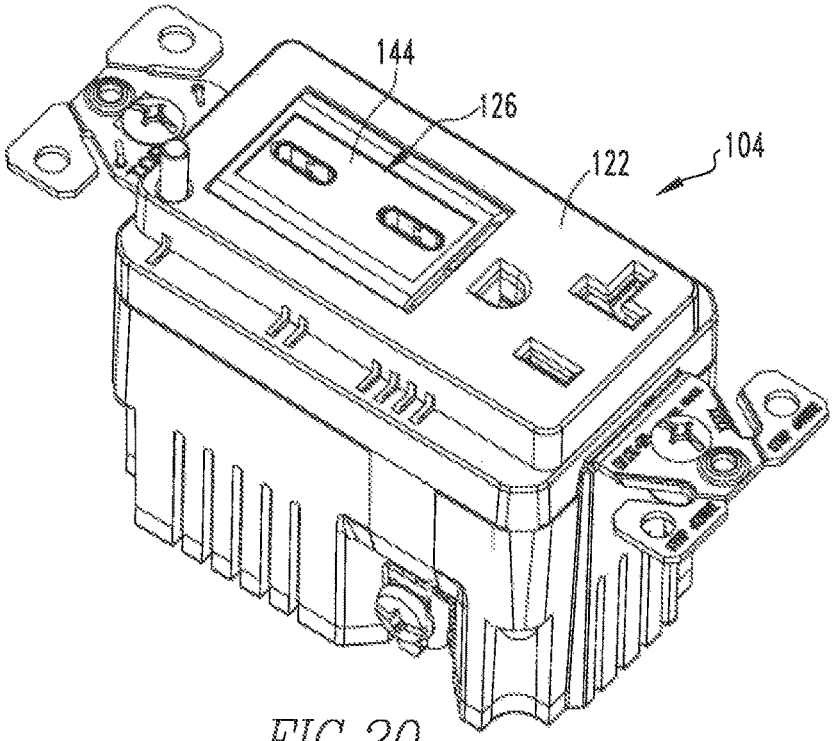
FIG. 20 is a perspective view of an improved electrical outlet in accordance with a second embodiment of the disclosed and claimed concept.
Figure 21:
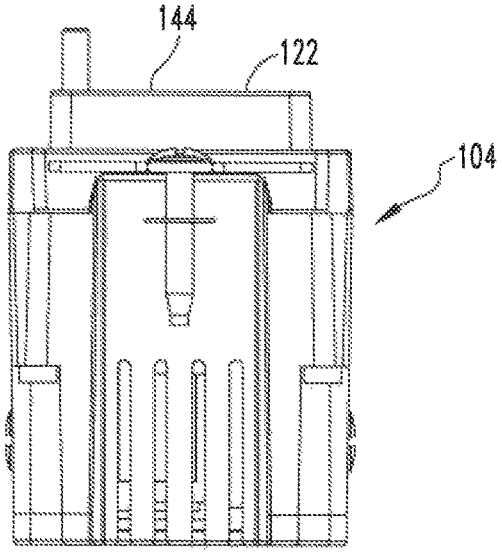
FIG. 21 is an end view of the second embodiment of FIG. 20.

In this regard, it can be seen that an improved electrical outlet 104 in accordance with a second embodiment of the disclosed and claimed concept is depicted generally in FIGS. 20 and 21 and has a slightly different physical configuration. The electrical outlet 104 is the same as the electrical outlet 4, except that it includes a power module 126 that is configured to be flush with the frontal surface 122 when in any of its exemplary orientations. For instance, FIG. 20 depicts a first orientation of the power module 126 wherein a surface portion 144 faces away from the frontal surface 122 and an electrical device situated on the surface portion 144 is operable, However, and as can be seen in FIG. 21, the surface portion 144 is flush with the frontal surface 122. Otherwise, the electrical outlet 104 is mechanically and electrically the same as the electrical outlet 4.

It is understood that either the electrical outlets 4 and 104 can be configured to include any appropriate number of surface portions and corresponding electrical devices on its power module. Likewise, the electrical devices can be in any combination and can include any one or more of the electrical devices 48 mentioned herein and/or other devices without departing from the spirit of the present concept. Other variations will be apparent.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An electrical outlet structured to be electrically connected with a line conductor and a neutral conductor of an AC power source, the electrical outlet comprising:

a base;

an electrical apparatus situated on the base;

the electrical apparatus comprising a power module situated on the base;

the power module having a plurality of electrical devices disposed thereon, at least a first electrical device of the plurality of electrical devices being an electrical output device that is structured to output electrical power;

the power module having an exterior surface, the exterior surface comprising a plurality of surface portions, each surface portion of at least some of the plurality of surface portions having at least a portion of at least a first electrical device of the plurality of electrical devices being situated adjacent thereto;

the power module being movable among a plurality of positions with respect to the base;

in each position of at least a plural quantity of the plurality of positions, a surface portion of the plurality of surface portions facing away from the base and the at least first electrical device situated adjacent the surface portion being electrically operable; and wherein the at least first electrical device comprises at, least one of a Universal Serial Bus (USB) connector and a wireless charging apparatus.

2. The electrical outlet of claim 1 wherein the power module is movably situated on the base.

3. The electrical outlet of claim 2 wherein the electrical apparatus comprises an actuation apparatus that is operable to move the power module among the plurality of positions.

4. The electrical outlet of claim 3 wherein the actuation apparatus comprises an actuator situated on the base, the actuator being movable between a first position and a second position and being biased toward the first position, the actuator engaging the power module during at least a portion of the movement from the first position to the second position and thereby moving the power modulo from a position wherein a first surface portion of the plurality of surface portions faces away from the base and another position wherein a second surface portion of the plurality of surface portions different from the first surface portion faces away from the base.

5. The electrical outlet of claim 1 wherein the base has a receptacle formed therein, and wherein the power module is received in the receptacle.

6. The electrical outlet of claim 5 wherein the base has a frontal surface situated adjacent the receptacle, and wherein in each said position of the at least plural quantity of the plurality of positions, the surface portion of the plurality of surface portions is situated flush with the frontal surface.

7. The electrical outlet of claim 5 wherein the base has a frontal surface situated adjacent the receptacle, and wherein in each said position of the at least plural quantity of the plurality of positions, the surface portion of the plurality of surface portions protrudes outwardly beyond the frontal surface.

8. The electrical outlet of claim 5 wherein the power module has a pair of ends, each surface portion of the plurality of surface portions being situated generally between the pair of ends, and wherein at least a first end of the pair of ends is rotatably situated on the base within the receptacle.

9. The electrical outlet of claim 8 wherein the power module includes a number of electrical contacts situated on at least one end of the pair of ends, each electrical device of the plurality of electrical devices being electrically connected with at least a first electrical contact of the number of electrical contacts.

10. The electrical outlet of claim 9 wherein the electrical apparatus further comprises a number of electrical connectors situated in the receptacle, at least a first electrical connector of the number of electrical connectors being electrically connected with at least a first electrical contact of the number of electrical contacts and providing electrical power to the at least first electrical contact and to a corresponding electrical device of the plurality of electrical devices that is electrically connected therewith when a corresponding surface portion of the plurality of surface portions to which the corresponding electrical device is situated adjacent faces away from the base.

11. An electrical outlet structured to be electrically connected with a line conductor and a neutral conductor of an AC r source, the electrical outlet comprising:

a base;

an electrical apparatus situated on the base;

the electrical apparatus comprising a power module situated on the base;

the power module having a plurality of electrical devices disposed thereon, at least a first electrical device of the plurality of electrical devices being an electrical output device that is structured to output electrical power;

the power module having an exterior surface, the exterior surface comprising a plurality of surface portions, each surface portion of at least some of the plurality of surface portions having at least a portion of at least a first electrical device of the plurality of electrical devices being situated adjacent thereto;

the power module being movable among a plurality of positions with respect to the base;

in each position of at least a plural quantity of the plurality of positions, a surface portion of the plurality of surface portions facing away from the base and the at least first electrical device situated adjacent the surface portion being electrically operable;

the power module being movably situated on the base; and wherein the electrical apparatus comprises an actuation apparatus that is operable to move the power module among the plurality of positions.

12. The electrical outlet of claim 11 wherein the actuation apparatus comprises an actuator situated on the base, the actuator being, movable between a first position and a second position and being biased toward the first position, the actuator engaging the power module during at least a portion of the movement from the first position to the second position and thereby moving the power module from a position wherein a first surface portion of the plurality of surface portions faces away from the base and another position wherein a second surface portion of the plurality of surface portions different from the first surface portion faces away from the base.

13. The electrical outlet of claim 12 wherein the actuation apparatus further comprises a lock that is engageable with a portion of the power module in the first position of the actuator to resist movement of the power module among the plurality of positions.

14. The electrical outlet of claim 13 wherein the actuator is connected with the lock, and wherein the lock, is in a position disengaged from the portion of the power module when the actuator is in the second position.

15. An electrical outlet structured to be electrically connected with a line conductor and a neutral conductor of an AC power source, the electrical outlet comprising:

a base;

an electrical apparatus situated on the base;

the electrical apparatus comprising a power module situated on the base;

the power module having a plurality of electrical devices disposed thereon, at least a first electrical device of the plurality of electrical devices being an electrical output device that is structured to output electrical power;

the power module having an exterior surface, the exterior surface comprising a plurality of surface portions, each surface portion of at least some of the plurality of surface portions having at least a portion of at least a first electrical device of the plurality of electrical devices being situated adjacent thereto;

the power module being movable among a plurality of positions with respect to the base;

in each position of at least a plural quantity of the plurality of positions, a surface portion of the plurality of surface portions facing away from the base and the at least first electrical device situated adjacent the surface portion being electrically operable;

wherein the base has a receptacle formed therein;

wherein the power module is received in the receptacle; and wherein the base has a frontal surface situated adjacent the receptacle, and wherein in each said position of the at least plural quantity of the plurality of positions, the surface portion of the plurality of surface portions is situated flush with the frontal surface.

16. An electrical outlet structured to be electrically connected with a line conductor and a neutral conductor of an AC power source, the electrical outlet comprising:

a base;

an electrical apparatus situated on the base;

the electrical apparatus comprising a power module situated on the base;

the power module having a plurality of electrical devices disposed thereon, at least a first electrical device of the plurality of electrical devices being an electrical output device that is structured to output electrical power;

the power module having an exterior surface, the exterior surface comprising a plurality of surface portions, each surface portion of at least some of the plurality of surface portions having at least a portion of at least a first electrical device of the plurality of electrical devices being situated adjacent thereto;

the power module being movable among a plurality of positions with respect to the base;

in each position of at least a plural quantity of the plurality of positions, a surface portion of the plurality of surface portions facing away from the base and the at least first electrical device situated adjacent the surface portion being electrically operable;

wherein the base has, a receptacle formed therein;

wherein the power module is received in the receptacle; and wherein the base has a frontal surface situated adjacent the receptacle, and wherein in each said position of the at least plural quantity of the plurality of positions, the surface portion of the plurality of surface portions protrudes outwardly beyond the frontal surface.

17. An electrical outlet structured to be electrically connected with a line conductor and a neutral conductor of an AC power source, the electrical outlet comprising:

a base;

an electrical apparatus situated on the base;

the electrical apparatus comprising a power module situated on the base;

the power module having a plurality of electrical devices disposed thereon, at least a first electrical device of the plurality of electrical devices being an electrical output device that is structured to output electrical power;

the power module having an exterior surface, the exterior surface comprising a plurality of surface portions, each surface portion of at least some of the plurality of surface portions having at least a portion of at least a first electrical device of the plurality of electrical devices being situated adjacent thereto;

the power module being movable among a plurality of positions with respect to the base;

in each position of at least a plural quantity of the plurality of positions, a surface portion of the plurality of surface portions facing away from the base and the at least first electrical device situated adjacent the surface portion being electrically operable;

wherein the base has a receptacle formed therein;

wherein the power module is received in the receptacle; and wherein the power module has a pair of ends, each surface portion of the plurality of surface portions being situated generally between the pair of ends, and wherein at least a first end of the pair of ends is rotatably situated on the base within the receptacle.

18. The electrical outlet of claim 17 wherein the power module includes a number of electrical contacts situated on at least one end of the pair of ends, each electrical device of the plurality of electrical devices being electrically connected with at least a first electrical contact of the number of electrical contacts.

19. The electrical outlet of claim 18 wherein the electrical apparatus further comprises a number of electrical connectors situated in the receptacle, at least a first electrical connector of the number of electrical connectors being electrically connected with at least a first electrical contact of the number of electrical contacts and providing electrical power to the at least first electrical contact and to a corresponding electrical device of the plurality of electrical devices that is electrically connected therewith when a corresponding surface portion of the plurality of surface portions to which the corresponding electrical device is situated adjacent faces away from the base.

20. The electrical outlet of claim 18 wherein the at least first electrical device includes at least one of a Universal Serial Bus (USB) connector and a wireless charging apparatus.

* * * * *